US008128383B2

(12) United States Patent
Pulliam

(10) Patent No.: US 8,128,383 B2
(45) Date of Patent: Mar. 6, 2012

(54) TOP SEAL ASSEMBLY

(76) Inventor: Kenny Pulliam, Midland, TX (US)

( * ) Notice: Subject to any disclaimer, the term of this patent is extended or adjusted under 35 U.S.C. 154(b) by 455 days.

(21) Appl. No.: 12/384,380

(22) Filed: Apr. 3, 2009

(65) Prior Publication Data

US 2010/0254839 A1 Oct. 7, 2010

(51) Int. Cl.
*F04B 47/00* (2006.01)

(52) U.S. Cl. ..... 417/448; 166/105

(58) Field of Classification Search ..... 417/554, 417/448; 166/68, 153, 372, 369, 105, 170–176, 166/387

See application file for complete search history.

(56) References Cited

U.S. PATENT DOCUMENTS

2005/0063848 A1* 3/2005 Howard ..... 417/554
2007/0267189 A1* 11/2007 Wells ..... 166/68

* cited by examiner

*Primary Examiner* — Anne Hines
(74) *Attorney, Agent, or Firm* — Robert C. Klinger

(57) ABSTRACT

A downhole sucker rod pump including a brush disposed between the downhole pump barrel and the well tubing to provide an effective seal which is not damaged during the insertion and/or withdrawal of the pump. The bush has a sufficient density and stiffness, such that it provides a sufficient interference fit between the pump barrel and the well tubing, that which retains its integrity with damage during the insertion and withdrawal process of a deep well.

20 Claims, 2 Drawing Sheets

TOP SEAL ASSEMBLY

FIELD OF THE INVENTION

The present invention is generally related to the field of oil wells, and more particularly to downhole sucker rod pumps.

BACKGROUND OF THE INVENTION

In the oil industry, there are many types of oil pumps that may be utilized to extract petroleum oil from the earth, depending on the formation that the oil resides in. In a typical downhole well, a downhole sucker rod pump is usually utilized, and which is driven by a reciprocating pump arm situated on the site above the downhole well.

While downhold sucker rod pumps have been utilized for many years, there are still challenges and problems that operators face, including the lodging of solids between the inner diameter of the well tubing and the outer diameter of the downhole pump, specifically, the barrel which includes the moving plunger/piston therewithin. These solids residing in the drawn oil may undesirably settle and become wedged between the pump barrel and tubing, which poses a significant problem when the pump is removed for servicing. These wedged solids may cause damage to the pump, and/or provide an extremely difficult, time consuming and expensive withdrawal of the pump which results in lost revenue.

Downhole wells may easily reach 10,000 or 12,000 feet, which depth exacerbates the recovery of the pump for servicing. One prior art solution is to provide a rubber gasket about the pump barrel to provide a seal between the barrel and well tubing. This solution has many problems, as the rubber gasket is typically damaged by the significant friction when the pumped is disposed such great distances into the earth. These rubber gaskets can be easily torn, or broken off all together during the positioning of the pump into the tubing, deep in the earth, rendering the resilient rubber gasket worthless.

There is desired an improved system for preventing solids from lodging between a pump barrel and the well tubing, while maintaining a seal, which allows the downhole pump to be effectively disposed deep in the earth, and which provides for a manageable and inexpensive withdrawal of the pump for servicing.

SUMMARY OF INVENTION

The present invention achieves technical advantages as a downhole sucker rod pump including a brush disposed between the downhole pump barrel and the well tubing to provide an effective seal, and which is not damaged during the insertion and/or withdrawal of the pump. The brush has a sufficient density and stiffness, such that it provides a sufficient interference fit between the pump barrel and the well tubing, that which retains its integrity without damage during the insertion process in a deep well.

DETAILED DESCRIPTION OF THE PRESENT INVENTION

Figure 1:
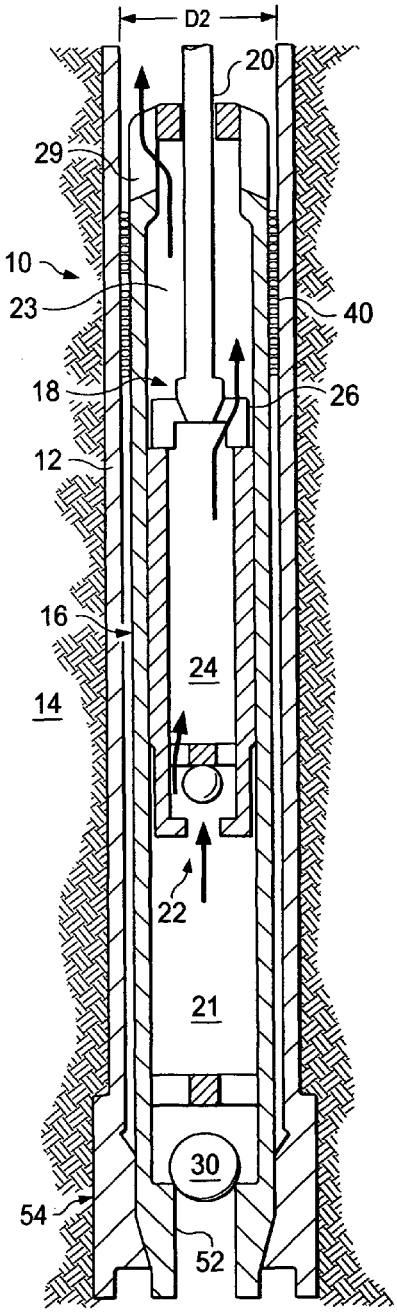
FIG. 1 is a cross sectional view of a downhole sucker rod pump showing the pump operation during a down stoke, drawing oil below the traveling piston through a check valve.

Referring now to FIG. 1, there is shown a cross sectional view of a downhole sucker rod pump generally at 10. Pump 10 is seen to include well tubing 12 vertically disposed in a well hole and interfaced to the earth 14 thereabout. Pump 10 is further seen to include a pump barrel 16 having disposed therein a vertically traveling piston 18 operating as a piston/plunger, vertically manipulated by a sucker rod 20 as is conventional in the art. FIG. 1 depicts the sucker rod 20 pushing the piston 18 downwardly in the housing 16 such that oil within a lower cavity 21 of the housing is drawn through a pump check valve 22 into a piston cavity 24, and also expelled through upper openings 26 of the piston as shown by the arrows. During the down stroke of the piston 18, oil also transfers from the piston cavity 24 into cavity 23 above the piston 18 via barrel opening 29, as shown.

Figure 2:
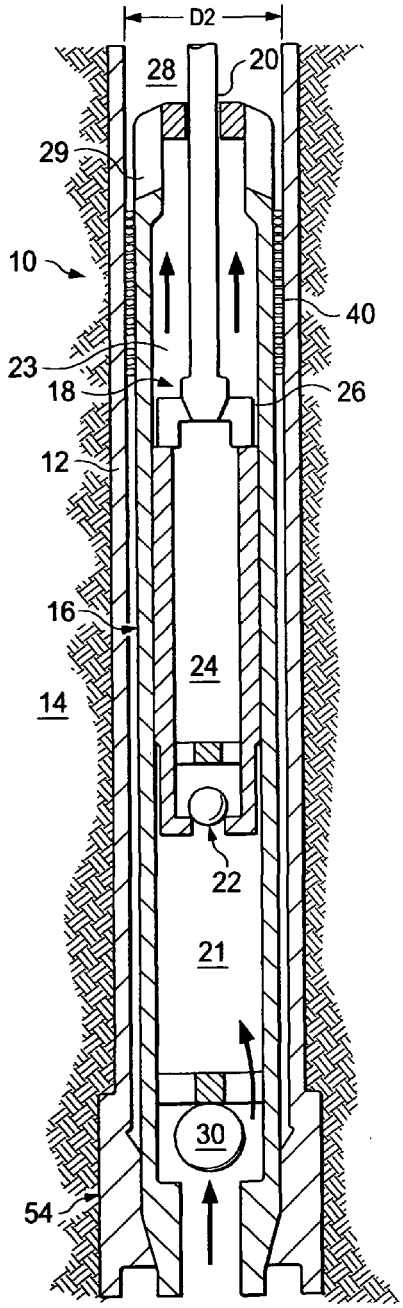
FIG. 2 depicts the upstroke of the piston pulling oil to the surface and drawing more oil into the tubing therebelow through a lower check valve of the barrel.

Referring to FIG. 2, there is shown the piston 18 during an upstroke, whereby the check valve 22 closes and oil residing above piston 18 in the chamber 28 of barrel housing 16 is compressed upwardly and ultimately for recovery above the oil well at the surface. During this upstroke oil is also drawn from within the oil reservoir through a check valve 30 of the barrel housing and into the barrel housing chamber 21.

Turning now back to FIG. 1, there is shown one preferred embodiment of the present invention seen to include a brush seal 40 secured in an interference fit between the pump barrel 16 outer diameter (OD) and the well tubing 12 inner diameter (ID) proximate an upper portion of the barrel 16, as shown. The outer diameter of the barrel 16 in combination with the brush 40 disposed thereagainst is greater than the inner diameter of the well tubing 12 such that a secure interference fit is realized and provides a seal. Advantageously, solids and other particulates that may be drawn with the oil upwardly through the openings 29 of the barrel 16 may settle upon the brush 40, but will not become lodged between the barrel 16 and the tubing 12. Advantageously, the brush 40 has a sufficient density and thickness due to the bristles forming the brush, and a sufficient seal is obtained. Moreover, the brush 40 will not become damaged during the prolonged insertion or withdrawal process of the barrel 16, such as when disposed in oil wells of up to 12,000 feet or more. This brush 40 will not become torn, tear or loose integrity, even when disposed in a well for a prolonged periods of time. Moreover, this brush is relatively inexpensive, and easily disposable upon an outer surface of the top seal assembly including housing 16.

Figure 3:
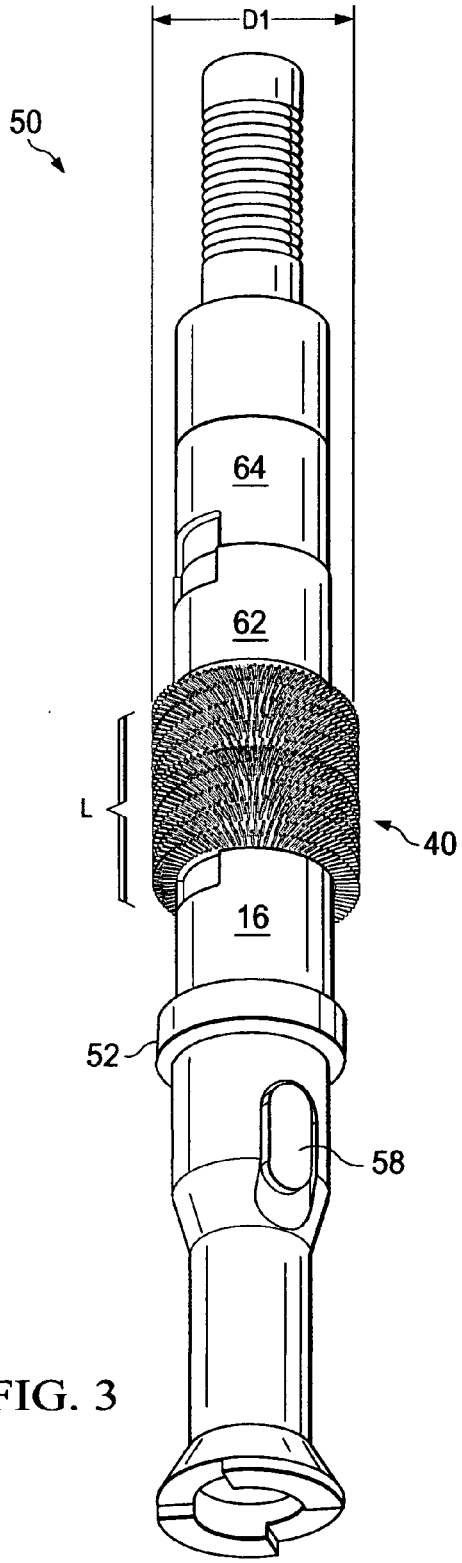
FIG. 3 depicts a perspective view of the top seal assembly including the brush seal according to one embodiment of the present invention.
Figure 4:
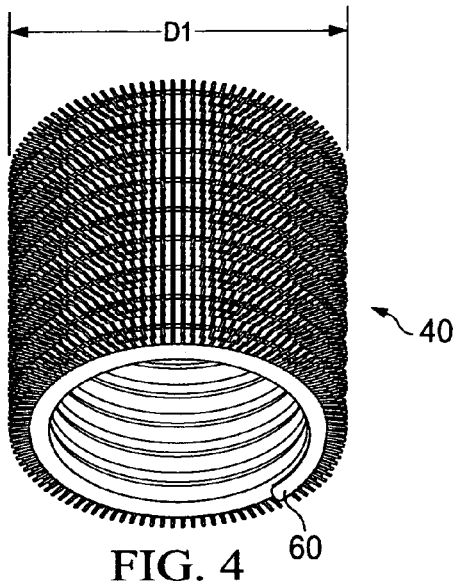
FIG. 4 is an enlarged perspective view of one embodiment of the top seal brush according to one embodiment of the present invention.

Referring now to FIG. 3, there is shown a perspective view of one embodiment of a top seal assembly 50 including the brush seal 40 accordingly to the present invention. The top seal assembly 50 is seen to include an elongated member typically comprised of stainless steel having various sections of various diameters. Portion 52 has the greatest diameter and is configured to be seated into the well tubing 12 and secured at a lower end thereof such that the barrel is secured and stationary with the tubing 12 at a lower end thereof, as shown generally at 54 in FIGS. 1 and 2. This portion 52 has an outer diameter greater than the inner diameter of tubing 12 at portion 54 such that it seats upon the reduced diameter at 54 and remains stationary during the operation of the piston assembly. Further shown in FIG. 3 is the upper portion of barrel 16 including the brush 40 according to one preferred embodiment of the present invention. Brush 40 has a length L, and an outer diameter D1, as also shown in FIG. 4. The diameter of the brush 40, D1, is greater than the diameter of the seating flange portion 52, and is also greater than the inner diameter of the tubing 12 as shown in FIG. 1, referred to as diameter D2. Specifically, D1 is greater than diameter D2 (D1>D2) such that an interference fit and seal is achieved as discussed with regards to FIG. 1 and FIG. 2.

Referring to FIG. 4, there is shown an enlarged perspective view of brush 40, seen to comprise of a coiled brush having a coiled backing 60 comprised, preferably of stainless steel. Because the brush backing 60 is coiled, it is somewhat flexible such that it can be axially stretched and disposed over barrel portion 62 when an upper portion 64 is theadably detached from portion 62 during assembly.

Figure 5:
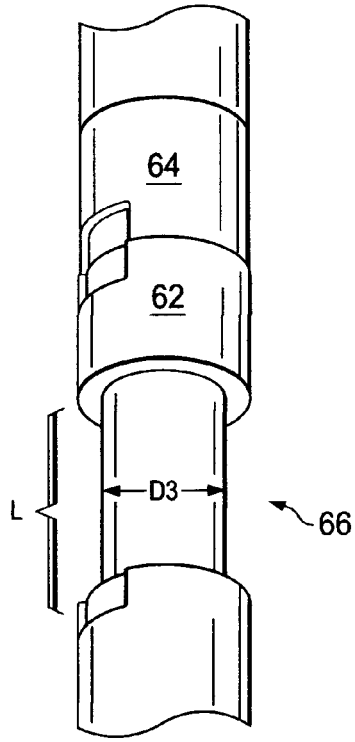
FIG. 5 is a partial view of the top seal assembly with the brush removed and depicting the recessed area configured to receive the brush thereabout according to the present invention.

As shown in FIG. 5, housing 16 has a significantly reduced diameter at portion 66 which is adapted to receive the bush 40 securingly thereabout. This portion 66 has a diameter D3, as shown. The inner diameter (ID) of brush 40 is equal to, or slightly less than, the diameter D3 such that brush 40 securely resides about portion 66 along the entire length L, such that it is secured in the axial direction, as shown.

Turning back to FIG. 4, in one preferred embodiment, and without limitation thereto, brush 40 may have a diameter D1 of 2", wherein the diameter D2 of the tubing 12 as shown in FIG. 1 may be 1.995". The diameter of barrel portion 66, D3 may be 1.187". This provides an interference fit of +0.005 (D1−D2). The length of the brush, L, maybe 3". The brush may be further characterized as having nylon bristles, comprised of nylon #612, being heat resistant, and each bristle having a 0.008 inch diameter.

In a second preferred embodiment, brush 40 may have a diameter D1 of 2.500", wherein the diameter D2 of the tubing 12 as shown in FIG. 1 may be 2.441". The diameter of barrel portion 66, D3 may be 1.562". This provides an interference fit of +0.005". The length of the brush may be 3.250". The brush may be of the same characterization with discussed as to the first embodiment, but may also be comprised of a different material or bristle size to achieve a sufficient interference fit and obtain the desired seal as discussed in the specification. Of course, one of skill in the art will realize that other types of bushes may be utilized without departing from the scope of the present invention.

Though the invention has been described with respect to a specific preferred embodiment, many variations and modifications will become apparent to those skilled in the art upon reading the present application. The intention is therefore that the appended claims be interpreted as broadly as possible in view of the prior art to include all such variations and modifications.

What is claimed is:

1. A downhole pump, comprising:

a stationary barrel tube having an upper portion, a lower portion and having an outer wall, and configured to remain stationary in a downhole well tubing;

a well pump including a plunger configured to be displaced within the stationary barrel tube, the well pump configured to couple to a sucker rod; and a non-elastic seal member sealingly disposed on the outer surface of the stationary barrel tube at a location above the lower portion of the stationary barrel tube and configured to prevent solids from lodging between the well tubing and the stationary barrel tube below the seal member.

2. The downhole pump as specified in claim 1 wherein the seal member is disposed proximate the upper portion of the stationary barrel tube.

3. The downhole pump as specified in claim 2 wherein the stationary barrel tube lower portion includes a seating mechanism configured to secure the stationary barrel tube to the well tubing.

4. The downhole pump as specified in claim 3 wherein the stationary barrel tube is configured to define a chamber between the seal and seating mechanism when configured in the well tubing, the chamber being free of solids emanating from a fluid pumped by the well pump.

5. The downhole pump as specified in claim 2 wherein the stationary barrel tube upper portion has an opening configured to pass a fluid therethrough, wherein the seal is disposed closely proximate and below the opening.

6. The downhole pump as specified in claim 1 wherein the seal member is configured to be deformable.

7. The downhole pump as specified in claim 1 wherein the seal member is comprised of a bristles.

8. The downhole pump as specified in claim 7 wherein the bristles form a brush.

9. The downhole pump as specified in claim 8 wherein the brush further comprises a bendable backing.

10. The downhole pump as specified in claim 9 wherein the bendable backing is coiled.

11. The downhole pump as specified in claim 8 wherein the brush forms an interference fit with the well tubing.

12. The downhole pump as specified in claim 11 wherein the brush has a diameter at least 2".

13. The downhole pump as specified in claim 11 wherein the interference fit is at least, about 0.005".

14. The downhole pump as specified in claim 13 wherein the well tubing has an inner diameter of about 2.441".

15. The downhole pump as specified in claim 8 wherein the brush is comprised of nylon bristles.

16. The downhole pump as specified in claim 15 wherein the brush has a length L of at least 3".

17. The downhole pump as specified in claim 16 wherein the brush length L is about 3.250".

18. The downhole pump as specified in claim 15 wherein the nylon bristles each have a diameter of about 0.008".

19. The downhole pump as specified in claim 15 wherein the nylon bristles comprise of heat resistant, nylon #612.

20. The downhole pump as specified in claim 1 wherein the well tubing has an inner diameter of about 1.995".

* * * * *